US006361042B1

(12) United States Patent
Shimura et al.

(10) Patent No.: US 6,361,042 B1
(45) **Date of Patent: *Mar. 26, 2002**

(54) SHEET ALIGNMENT DEVICE FOR USE IN A SHEET HANDLING DEVICE

(75) Inventors: Makoto Shimura, Yamanashi-ken; Takashi Saito, Sakaigawa-mura, both of (JP)

(73) Assignee: Nisca Corporation, Yamanashi-Ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/089,566

(22) Filed: Jun. 3, 1998

(30) Foreign Application Priority Data

Jun. 4, 1997 (JP) ..... 9-163397

(51) Int. Cl.[7] ..... B65H 9/16; B65H 31/36

(52) U.S. Cl. ..... 271/250; 271/221; 271/222; 271/223

(58) Field of Search ..... 271/250, 221, 271/222, 223; 270/58.12, 58.09; 414/788.9

(56) References Cited

U.S. PATENT DOCUMENTS

| | | | | | |
|---|---|---|---|---|---|
| 316,329 | A | * | 4/1885 | Brush | 271/222 |
| 360,921 | A | * | 4/1887 | Kauffman | 271/222 |
| 617,851 | A | * | 1/1899 | Carter | 271/222 |
| 1,008,651 | A | * | 11/1911 | Korff | 271/223 |
| 1,082,613 | A | * | 12/1913 | Spiess | 271/223 |
| 2,265,617 | A | * | 12/1941 | Yates | 271/222 |
| 4,318,541 | A | * | 3/1982 | Nagel et al. | 271/222 |
| 4,319,744 | A | * | 3/1982 | Nagel et al. | 271/222 |
| 4,867,436 | A | * | 9/1989 | Hanada et al. | 271/221 |
| 5,054,766 | A | * | 10/1991 | Seki et al. | 271/221 |
| 5,080,342 | A | * | 1/1992 | Mori et al. | 271/221 X |
| 5,090,673 | A | * | 2/1992 | Kitahara et al. | 270/53 |
| 5,215,303 | A | * | 6/1993 | Yamada et al. | 271/240 |
| 5,511,770 | A | * | 4/1996 | Okazaki | 271/4.01 |
| 5,890,713 | A | * | 4/1999 | Hofmann et al. | 271/221 |
| 6,085,913 | A | * | 7/2000 | Aiko et al. | 209/540 |

FOREIGN PATENT DOCUMENTS

| | | | | |
|---|---|---|---|---|
| GB | 9705 | * | 5/1899 | 271/221 |

* cited by examiner

*Primary Examiner*—Donald P. Walsh
*Assistant Examiner*—Richard Ridley
(74) *Attorney, Agent, or Firm*—Pitney, Hardin, Kipp & Szuch LLP

(57) ABSTRACT

A sheet alignment device is provided with a movable aligning member and a variable push member, movable to push one or more sheets fed onto a tray toward a sheet aligning reference surface defined on the tray, thus to align the sheets. The sheets of large size are pushed at the point close to the center of gravity of the sheets toward the aligning reference surface mainly by the variable push member, and the sheets of small size are pushed at the point close to the center of gravity of the sheets toward the aligning reference surface mainly by the movable aligning member. The sheets of any size can be properly pushed stably without experiencing an undesirable rotational moment, thus to be exactly aligned.

16 Claims, 14 Drawing Sheets

FIG. 10
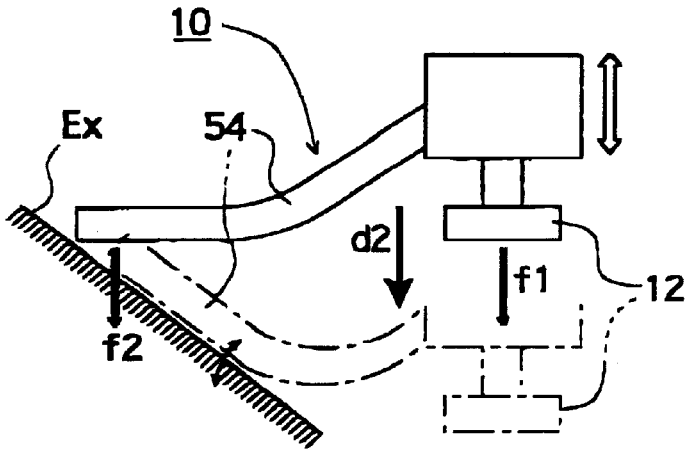
FIG. 11
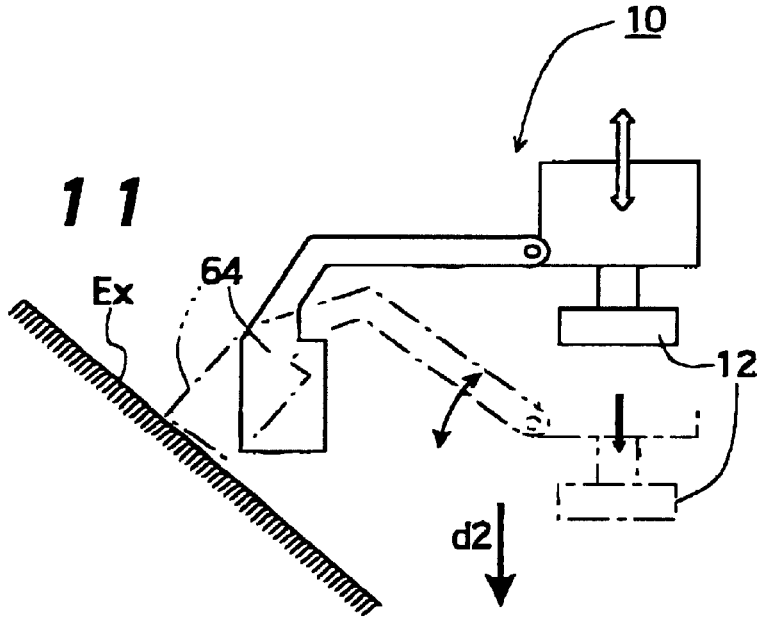
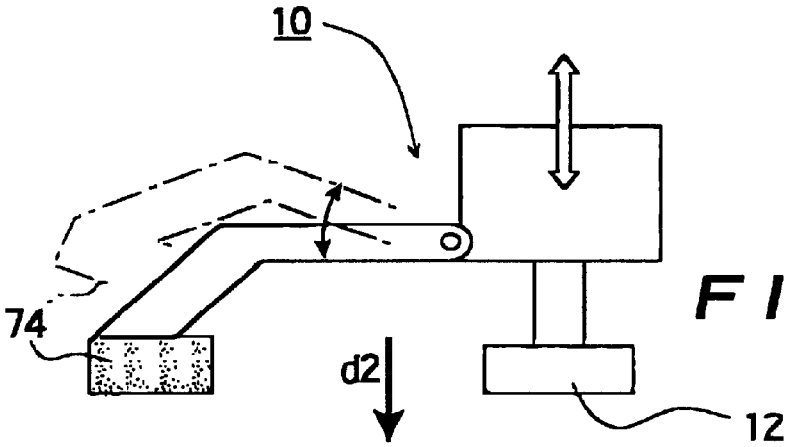
FIG. 12

SHEET ALIGNMENT DEVICE FOR USE IN A SHEET HANDLING DEVICE

BACKGROUND OF THE INVENTION

1. Field of the Invention

This invention relates to a device for aligning one or more sheets, which is incorporated in a sheet handling device applied for a copying machine or the like, and more particularly to a sheet alignment device capable of exactly aligning sheets by pushing the sheets at the position close to the center of gravity thereof toward a predetermined aligning reference surface.

2. Description of the Prior Art

There has been known a sheet handling device generally so-called "sorter" or "finisher" for automatically sorting and stapling or punching sheets fed continuously from an image forming apparatus such as a copying machine and printer.

The sheet handling device as noted above has been usually provided with a device for aligning the sheets fed from the image forming apparatus so that the one side edges of the sheets are trued up with a predetermined aligning reference surface. The sheets stacked on an inclined tray are spontaneously aligned in one direction as the sheets slide down the slope of the inclined tray on account of their own weight, but they must be aligned by force in the direction perpendicular to that in which the tray is inclined.

A conventional way of aligning the sheets fed from the image forming apparatus such as the copying machine to the sheet handling device will be described with reference to FIG. 1A. As an illustration, the sheet handling device A has a tray T inclined upward in relation to a sheet introduction direction d1 in which the sheets are fed from the image forming apparatus M.

There is formed a sheet receiving wall F1 serving as a widthwise sheet aligning reference surface b1 vertically standing along the lower end (right end in the drawing) of the inclined tray T. The sheet s1 fed onto the inclined tray T spontaneously slides down the slope of the inclined tray in the opposite direction to the sheet introduction direction d1, and then, collides with the sheet receiving wall F1. In the same way, the following sheets fed from the image forming apparatus M also collide with the sheet receiving wall F1. As a result, all the sheets are automatically aligned in the sheet introduction direction d1.

The sheet handling device is provided with an aligning member PR for forcibly pushing the sheets toward a side wall F2 serving as a lengthwise sheet aligning reference surface b2 to align the sheets in the direction d2 (hereinafter, referred to as "aligning direction"). That is to say, the sheet s1 fed onto the tray T is pushed against the lengthwise sheet aligning reference surface b2 of the side wall F2 by the aligning member PR. The sheets thus aligned may be bound by a stapler ST as occasion calls.

When the sheets are aligned in the aligning direction d2, it is desirable to push the sheets at the portion close to the center of gravity of the sheets (normally, the center of the sheets). In other words, the sheet s1 can be effectively pushed without strain with decreasing a deflection δ1 from the center of gravity G1 of the sheet s1 to the point at which the sheet is pushed by the aligning member PR in the sheet introduction direction d1 in the system shown in FIG. 1A. If the sheets to be handled by the system are fixed in size, it is possible to minimizing the deflection δ1. However, the sheets which are practically used are irregular in size and different in the center of gravity as a matter of course. When the sheet to be handled is large as shown in FIG. 1B, the deflection δ2 between the center of gravity G2 of the sheet s2 and the point at which the sheet is pushed by the aligning member PR is increased, resulting in a large rotating moment r imposed on the sheet. Consequently, the sheet is liable to rotate on the tray during the aligning process.

When dealing with a sheet of small size (i.e. A4 size) as illustrated in FIG. 1A, the deflection δ1 lessens to bring about a negligible rotating moment. However, the use of a sheet of large size (i.e. A3 size) causes large deflection δ2 which entails a disadvantage such as failure in transporting the sheet and other possible accidents.

Specifically in a sorter for a copying machine handling sheets of various sizes, sheet alignment must be properly accomplished since its certainty inflicts on quality of the sheets finally obtained.

OBJECT OF THE INVENTION

An object of the present invention is to provide a sheet alignment device capable of stably and exactly aligning sheets fed from an image forming apparatus.

Another object of the invention is to provide a sheet alignment device capable of exerting a pushing force on one or more sheets at a proper point determined according to the size of the sheet so as to suitably push the sheets against a sheet aligning reference surface without causing a rotational moment, thereby to stably align the sheets.

Still another object of the invention is to provide a high-efficient sheet alignment device having a driving system simple in structure, which can effectively exert a proper pushing force on sheets of different sizes to precisely align the sheets.

Yet another object of the invention is to provide a sheet alignment device capable of precisely handling and aligning sheets with high efficiency, which is applicable to not only various types of image forming apparatuses such as a copying machine, printer and facsimile, but also various sheet handling apparatuses such as a sheet stacker, sheet sorter and bookbinding apparatus.

SUMMARY OF THE INVENTION

To attain the objects described above according to the present invention, there is provided a sheet alignment device comprising a sheet storing unit; sheet aligning means including a movable aligning member which is movable back and forth toward a sheet aligning reference surface, and a variable push member movable in conjunction with the movable aligning member to push one or more given sheets in accordance with the size of the sheets; and means for moving the movable aligning member and variable push member in relation to the sheet aligning reference surface.

The movable aligning member and the variable push member which are operatively associated with each other are so arranged that when a given sheet is small in size, the movable aligning member is positioned so as to come into contact with the given sheet at a portion close to the center of gravity of the sheet of small size, and when the given sheet is large in size, the variable push member is positioned so as to come into contact with the given sheet at a portion close to the center of gravity of the sheet of large size.

During the aligning process, the movable aligning member moves toward the sheet aligning reference surface to exert the pushing force on the sheet or sheets no matter what the size of the sheet or sheets is.

When aligning one or more sheets of large size, the variable push member always comes into contact with the sheets to push the sheets toward the sheet aligning reference surface, but when aligning one or more sheets of small size, it is out of contact with sheets. The variable push member is selectively activated or deactivated by operation converting means in accordance with the size of the sheet to be handled so as to exert the pushing force on the sheets of large size or be out of contact with the sheets of small size. The operation converting means may be formed of an edge of an opening in a tray of the sheet storing unit, so that the variable push member operable in concert with the movable aligning member is brought in collision with the operation converting means to be retracted backward, when dealing with the sheets of small size.

Thus, the effective pushing point defined substantially by the region at which one or more sheets are efficaciously pushed by the associated movable aligning member and variable push member can be practically shifted to a position close to the center of gravity of the sheets.

The variable push member may be connected to the movable aligning is member by a hinge, or formed of resilient elastic material.

Between the movable aligning member and the variable push member, there may be interposed a medium-size sheet pushing element for aligning a sheet of medium size, so as to carry out a three-step aligning function. Such a three-step aligning mechanism makes it possible to enlarge the limits of permitting the sheets of minimum size to maximum size to be dealt with.

Other objects and features of the present invention will be hereinafter explained in detail with reference to the accompanying drawings.

BRIEF DESCRIPTION OF THE DRAWINGS

FIG. 10 is a schematic plan view of a third embodiment of this invention.

FIG. 11 is a schematic plan view of a fourth embodiment of this invention.

FIG. 12 is a schematic plan view of a fifth embodiment of this invention.

DESCRIPTION OF THE PREFERRED EMBODIMENTS

The sheet alignment device according to this invention is generally incorporated in a sheet handling device serving to distribute and store one or more sheets given so as to align the sheet or sheets with a prescribed reference surface.

As the typical sheet handling device to which the sheet alignment device of the invention is applicable, there are a sheet storage apparatus to be united with an image forming apparatus such as a copying machine, facsimile, printer and printing machine to store sheets fed successively from the image forming apparatus, a sorter, a sheet finisher for stapling or punching the given sheets, or a sheet inverting apparatus for performing duplex copying. However, these sheet handling devices should not be understood as being limited thereto, and this invention is applicable to any type of sheet handling device.

Figure 1A:
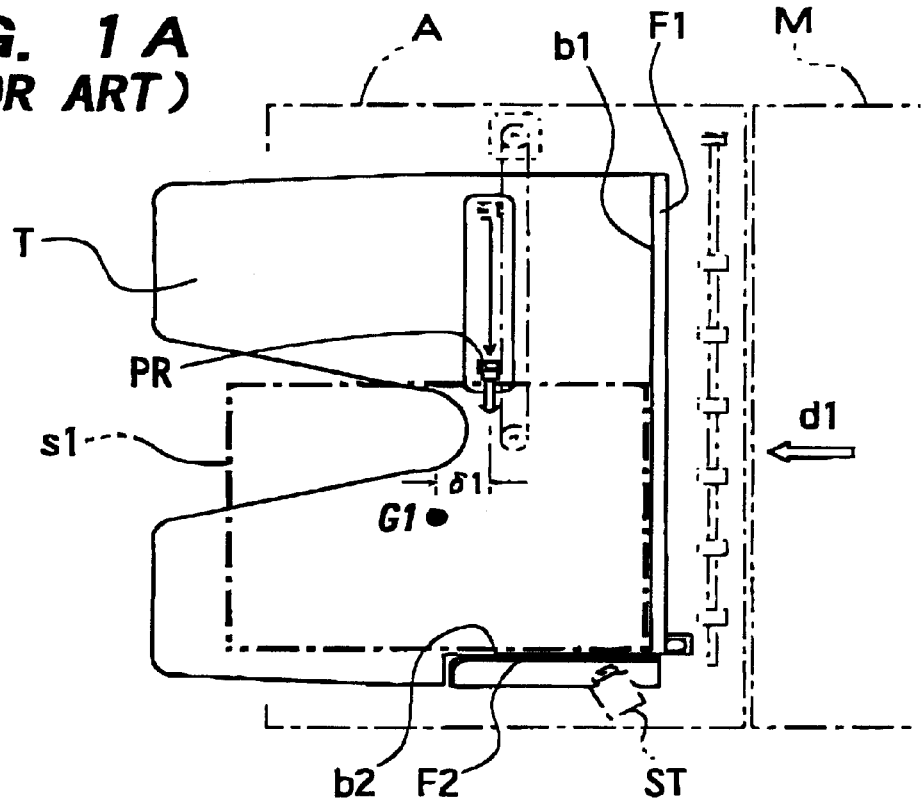
FIG. 1A (PRIOR ART)
FIG. 1A and FIG. 1B are schematic plan views illustrative of the operating principle of a prior art sheet alignment device for use in a sheet handling apparatus.
Figure 1B:
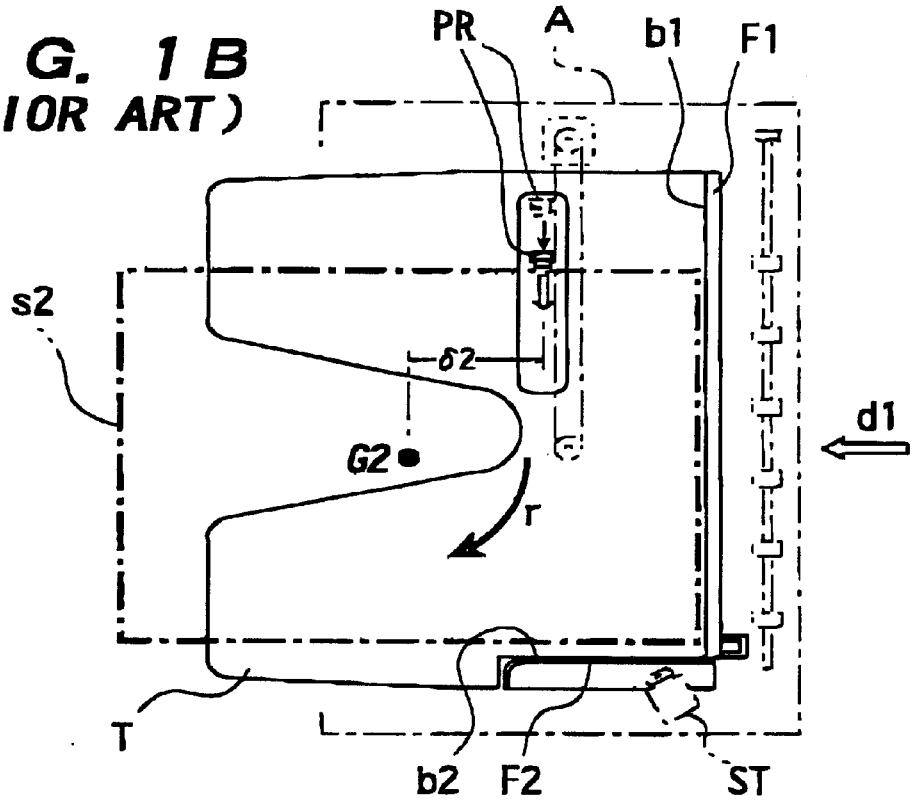
FIG. 1B (PRIOR ART)
Figure 2:
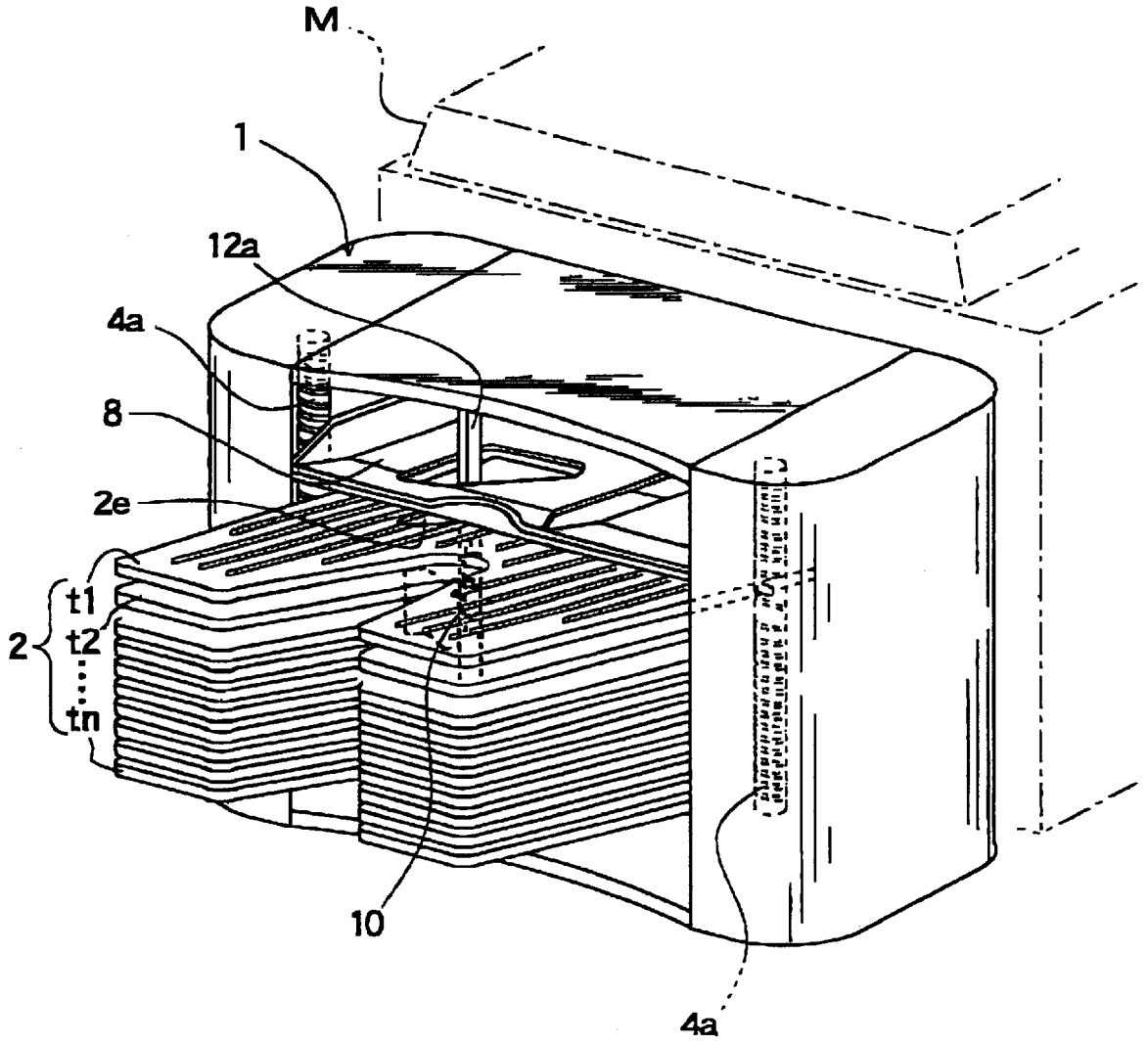
FIG. 2 is a schematic perspective view of one embodiment of a sheet alignment device according to this invention, which is applied to a sorter for a copying machine as one example.

As one example, the sheet alignment device of the invention is applied to a sorter used as the sheet handling device 1, which is united with a copying machine, as schematically shown in FIG. 2. As illustrated, the sorter 1 is joined to the sheet discharge portion of the copying machine M, so that sheets fed successively from the copying machine M are received by multi-stage trays 2 (t1, t2 . . . tm . . . tn) of the sorter.

Figure 3:
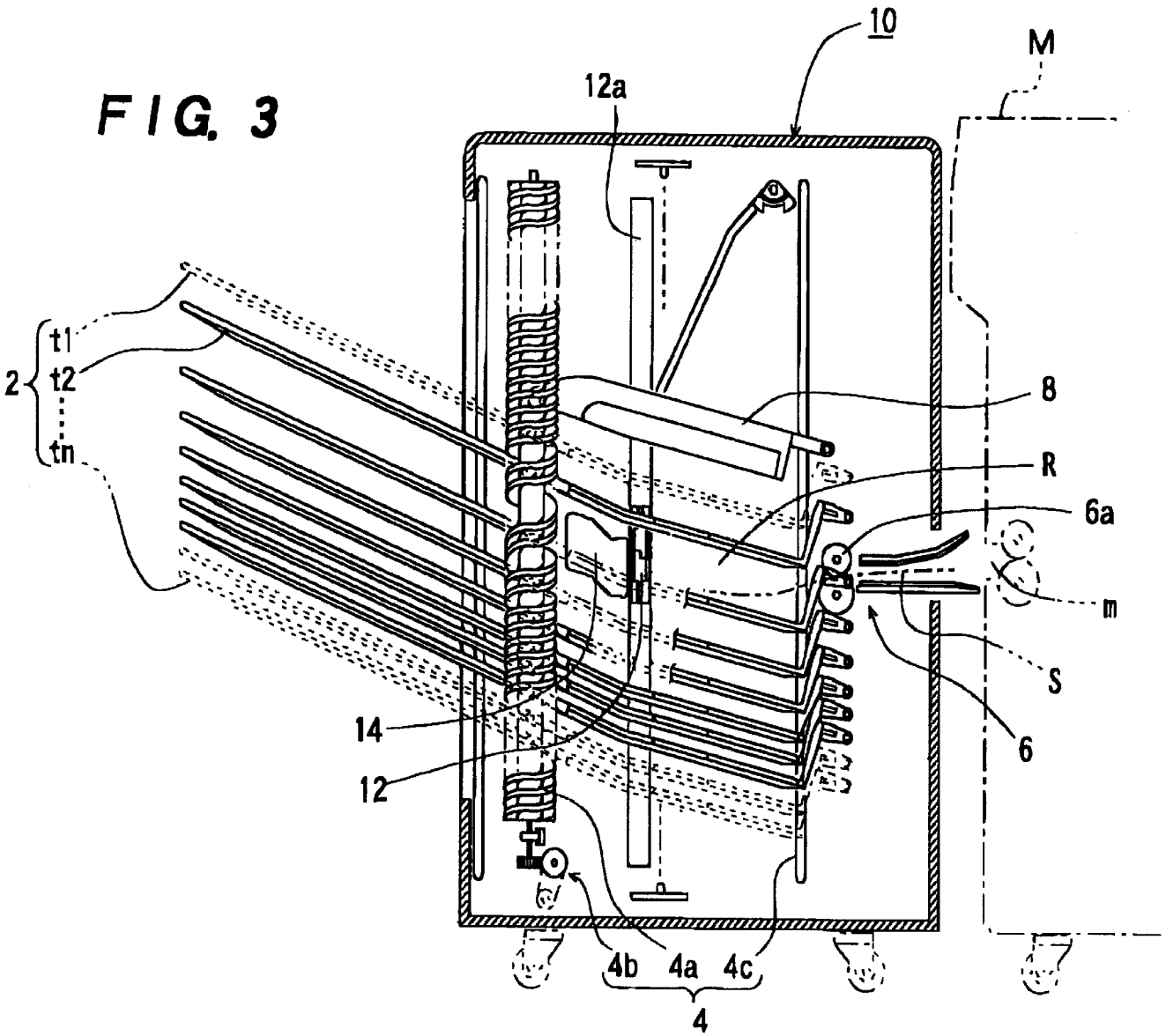
FIG. 3 is a front sectional view schematically showing the sorter in FIG. 2.

In the sorter 1 shown as one example, the trays 2 are arranged vertically one above another as shown in FIG. 3, and each movable up and down by operating a lifting mechanism 4. The given sheets are fed onto the respective trays in such a manner that the specified tray tm is moved to a sheet receiving portion 6 confronting a sheet discharge port m of the copying machine M by the lifting mechanism 4.

As shown in FIG. 3 as one example, the third tray t3 (strictly speaking, a storage space R formed between the second tray t2 and the third tray t3) confronts the sheet receiving portion 6 defined by introduction rollers 6*a*, so as introduce the sheet S fed from the copying machine M onto the third tray t3.

In the drawings, reference numeral 8 denotes auxiliary regulation member disposed above the uppermost first tray t1 to define a sheet storage space on the uppermost tray t1. The regulation member is moved vertically in concert with the trays 2 by the lifting mechanism 4.

The lifting mechanism 4 in the illustrated sorter 1 comprises a pair of lead crews 4*a* mounted one on either side of the trays 2, means 4*b* for selectively rotating the lead screws 4*a* in opposite directions, and guide slots 4*c* formed in a device housing to guide the trays 2 vertically movable in parallel. Into guide grooves of the lead screws 4*a*, lifting pins 2*a* fixed on the sides of the trays 2 are slidably fitted, so that the trays 2 can be moved up and down by rotating the lead screws 4*a*. The vertical parallel movements of the trays 2 are ensured by guide rollers 2*c* and 2*d* rotatably fitted into the guide slots 4*c*.

The guide groove of the lead screw 4*a* is made relatively wider in pitch at the middle portion of the lead screw, so that the two trays positioned thereat are widely separated from each other so as to facilitate the introduction of the sheet into the storage space formed between the trays.

The formation and arrangement of the lifting mechanism 4, sheet receiving portion 6 and regulation member 8 are not specifically limited in this invention.

One or more sheets s1,s2, . . . fed from the copying machine M onto the trays 2 of the sorter 1 are aligned on the trays in the sheet introduction direction d1 and the direction d2 (herein, referred to as "aligning direction") across the direction d1.

The alignment of the sheets in the sheet introduction direction d1 is automatically fulfilled by the trays which are respectively inclined upward in the direction d1 and each provided at the lower end thereof with a sheet receiving wall F1 serving as a widthwise aligning reference surface b1. With this arrangement, one or more sheets fed onto the specific tray thus inclined spontaneously slide down the slope of the inclined tray in the direction opposite to the direction d1 and come into collision with the widthwise aligning reference surface b1, consequently to align the sheets in the sheet introduction direction d1.

The alignment of sheets in the aligning direction d2 is fulfilled by the device of this invention. According to this invention, even the sheets of different size can be successfully aligned stably.

The sheet alignment device 10 shown in FIG. 2 through FIG. 7 as the first embodiment of the invention comprises a movable aligning member 12 which is moved back and forth in the widthward direction of the tray 2 (aligning direction d2) in the sheet storage unit, a variable push member 14 disposed in juxtaposition to the movable aligning member 12, and means 16 for moving back and forth the associated movable aligning member 12 and variable push member 14.

Figure 5:
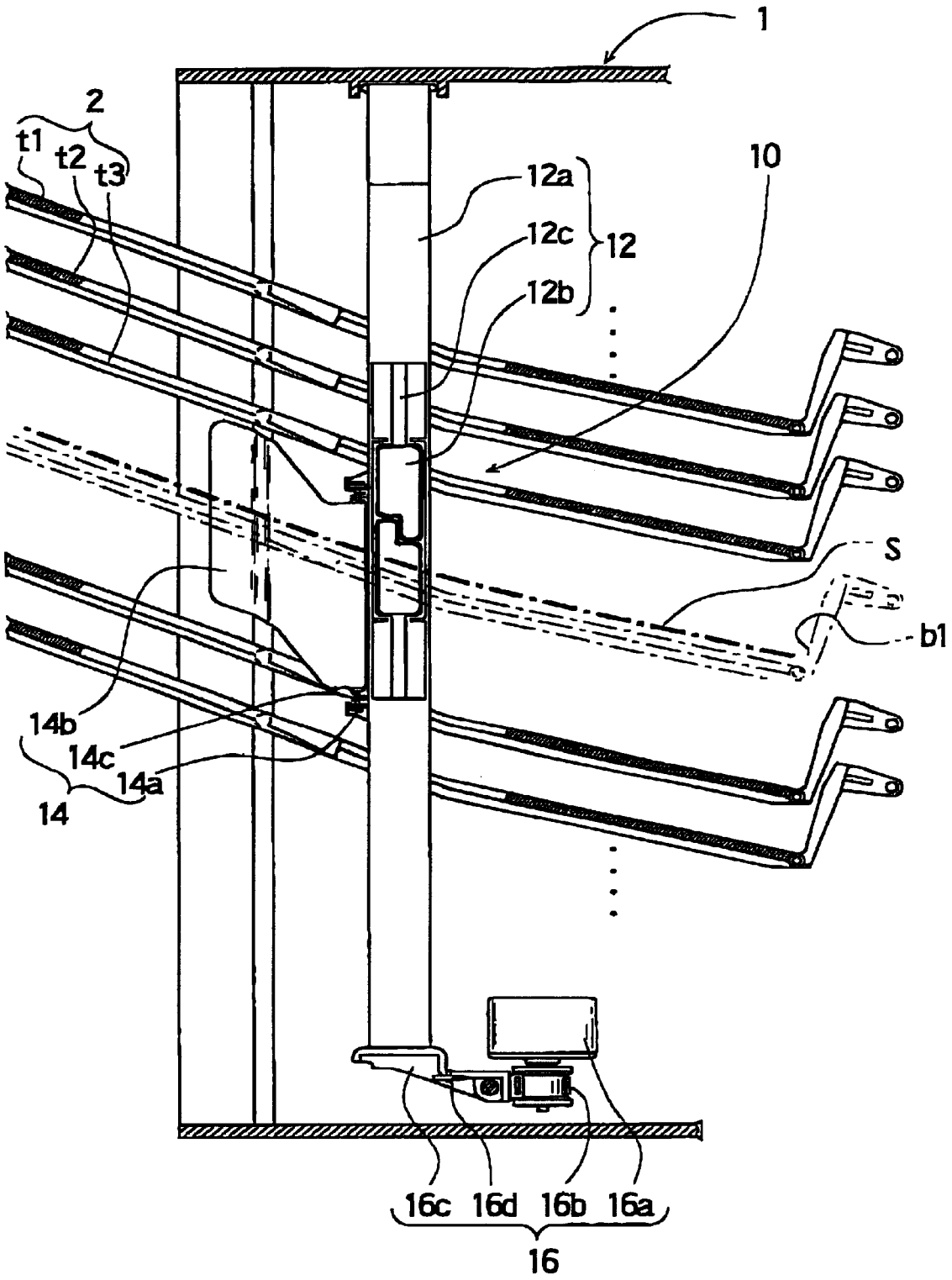
FIG. 5 is a front view showing the sheet alignment device of the invention.
Figure 6:
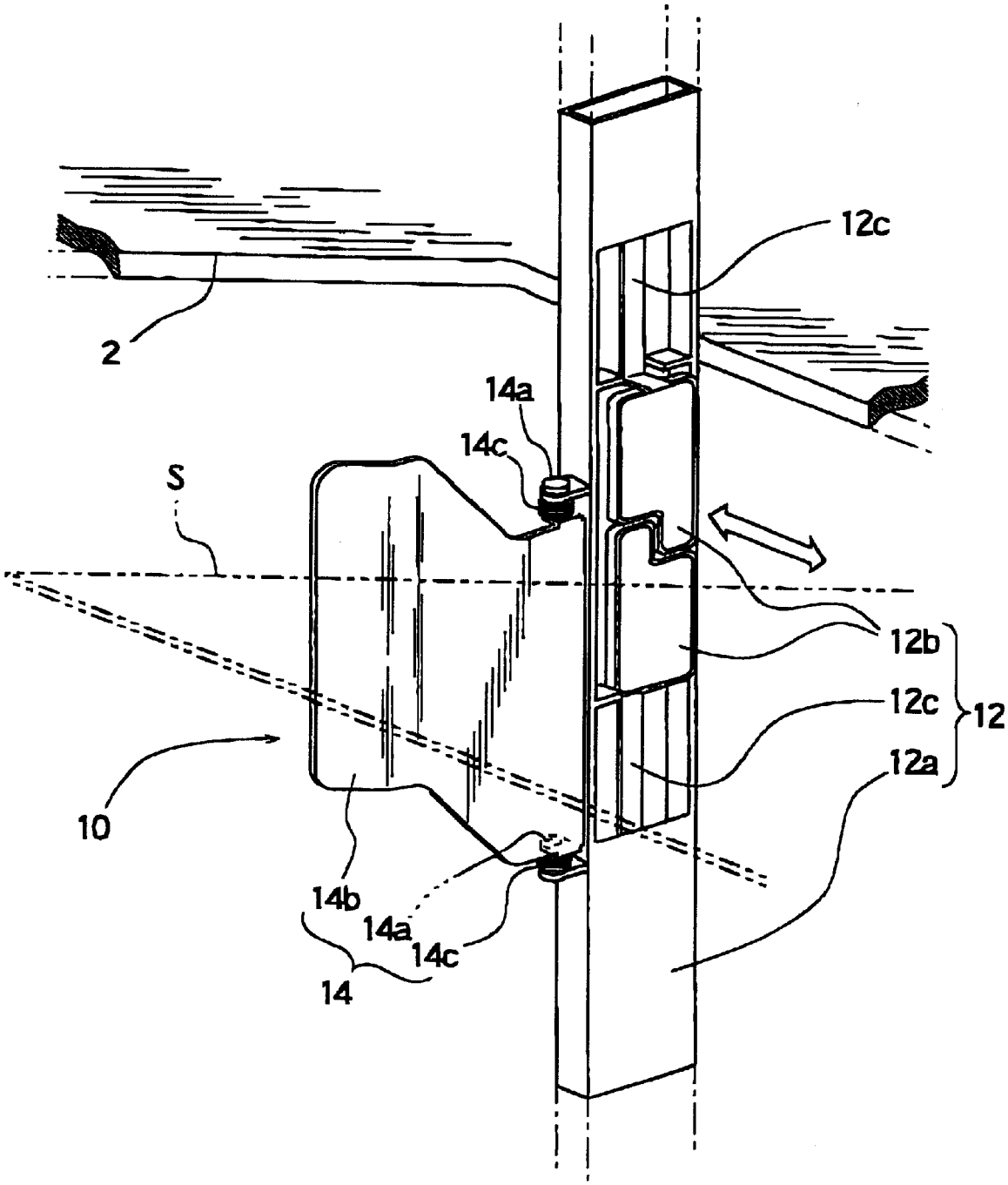
FIG. 6 is a perspective view showing the sheet alignment device of the invention.
Figure 7:
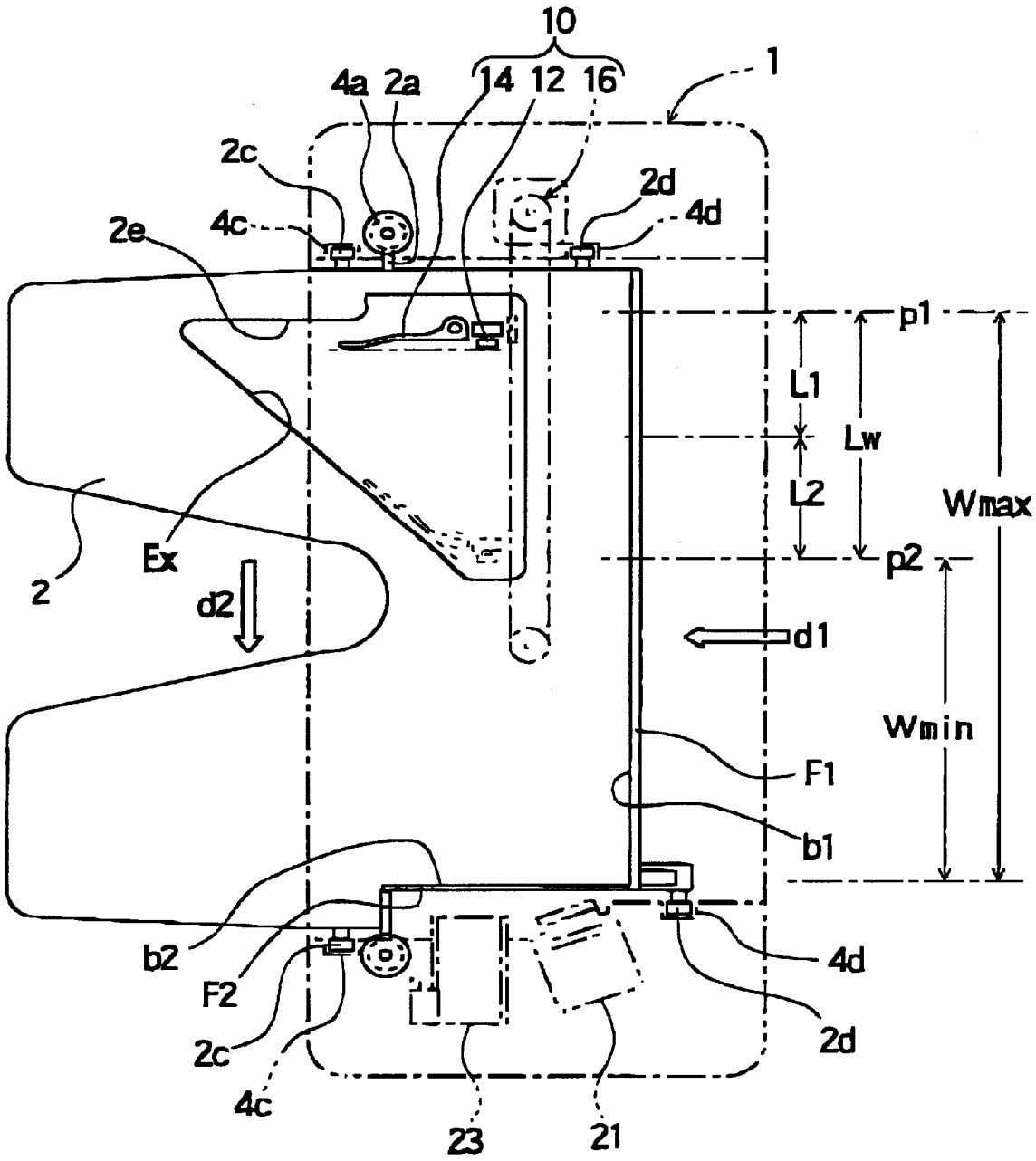
FIG. 7 is a schematic plan view showing a tray in the sorter incorporating the sheet alignment device of the invention.

As specifically shown in FIG. 5, FIG. 6 and FIG. 7 the movable aligning member 12 comprises a moving lever 12*a* extending vertically, which is moved horizontally in parallel in the aligning direction d2 by the moving means 16, a push pad 12*b* mounted at the nearly middle portion of the moving lever 12*a*, and resilient supporting members 12*c* for resiliently securing the push pad 12*b* onto the moving lever 12*a*.

The push pad 12*b* in this embodiment are formed of a pair of upper and lower pad elements flexibly connected to each other, but should not be understood as being limited to this structure, and may be formed in any shape and of any material insofar as the push pad can be brought in elastic contact with the sheets on the tray.

The variable push member 14 is formed of a flap-like plate connected to the moving lever 12*a* of the movable aligning member 12 by one or more hinges 14*a*, and provided at its free end part with a contact surface 14*b* at which the variable push member comes into flat contact with the sheets. The variable push member 14 is positioned at the substantially middle portion of the vertical length of the moving lever 12*a* and constantly urged frontward by resilient means 14*c* such as a coil spring so as to be on the same plane with the front surface of the push pad 12*b* (FIG. 7).

The tray 2 has a lengthwise sheet aligning reference surface b2 serving as the basic point for aligning the given sheets in the aligning direction d2. The lengthwise aligning reference surface b2 is formed by the side wall F2 standing is vertically from one edge of the tray. Namely, the associated movable aligning member 12 and variable push member 14 for directly exerting the push force on the sheets are together moved toward the aligning reference surface b2 to align the sheets stacked on the tray with the lengthwise aligning reference surface b2 (aligning function).

In order to permit the sheet alignment device 10 consisting of the movable aligning member 12 and the variable push member 14 to act on a plurality of trays arranged vertically one above another, all the trays are provided with openings 2*e* lined up vertically, so as to insert the sheet alignment device in the lined openings.

Thus, the extent of permitting the sheet alignment device 10 to move in the aligning direction d2 is substantially defined by the length Lw of the opening 2*e* in the aligning direction. That is, the length from the lengthwise aligning reference surface b2 to the rear end p1 of the moving extent Lw corresponds to the maximum width Wmax of the sheet which can be handled by the sheet alignment device of the invention, and the length from the lengthwise aligning reference surface b2 to the front end p2 of the moving extent Lw corresponds to the minimum width Wmin of the sheet which can be handled by the sheet alignment device of the invention.

Figure 4:
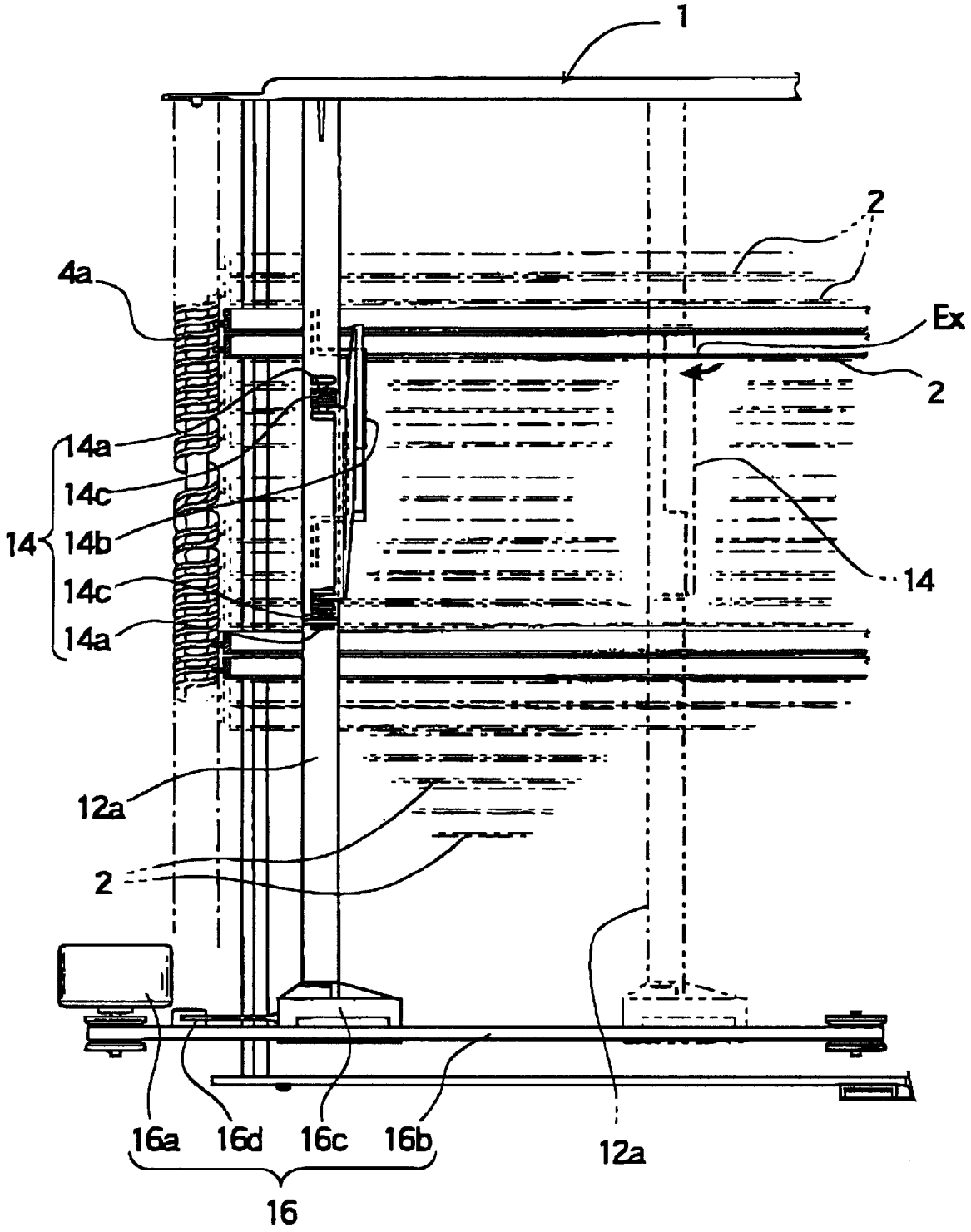
FIG. 4 is a schematic side view showing in part the sorter in FIG. 2.

The moving means 16 for moving back and forth the associated movable aligning member 12 and variable push member 14 in the aligning direction d2 comprises driving means 16*a* including a motor, an endless belt 16*b* driven in opposite directions by the driving means 16*a*, and means 16*c* for connecting the moving lever 12*a* of the movable aligning member 12 to the belt 16*b*. The connecting means 16*c* is provided with a limiter 16*d* for stopping the movable aligning member 14 at the rear end pl of the moving extent Lw (FIG. 4 and FIG. 5).

By operating the moving means 16, the sheet alignment device consisting of the movable aligning member 12 and variable push member 14 can be moved back and forth in the moving extent Lw. To be more specific, by operating the driving means 16*a* in accordance with the size of the given sheet, which is manually specified on the sorter or detected by a suitable sensor (not shown) disposed on the sorter, the associated movable aligning member 12 and variable push member 14 constituting the sheet alignment device fulfill the desired sheet aligning function of exerting the composite pushing force on the given sheets.

In the illustrated embodiment, the opening 2*e* formed in the tray is shaped in a substantial triangle, but the shape of the opening is not specifically limited thereto. However, the operation converting means Ex inclined relative to the direction of moving the associated members 12 and 14 is indispensable to the device of the invention. The operation converting means Ex in this embodiment is formed of the inclined edge of the triangular opening 2*e* in the tray, but the opening is not absolutely necessary to this invention.

The relation between the variable push member 14 and the operation converting means Ex is so determined that the variable push member 14 comes into contact with the operation converting means Ex when it is positioned substantially within the front half (second half) L2 of the moving extent Lw defined by the opening 2*e*.

That is, the variable push member 14 is kept on the same plane with the push pad 12*b* when positioned substantially in the first half L1 of the moving extent (as depicted by the solid line in FIG. 7), but it collides with the operation converting means Ex to retreat backward when positioned substantially in the second half L2 of the moving extent (as depicted by the chain line in FIG. 7). The variable push member 14 in the second half L2 of the moving extent is rotated backward (clockwise direction in FIG. 7) about the hinge 14*a* against the spring 14*c*.

Figure 8A:
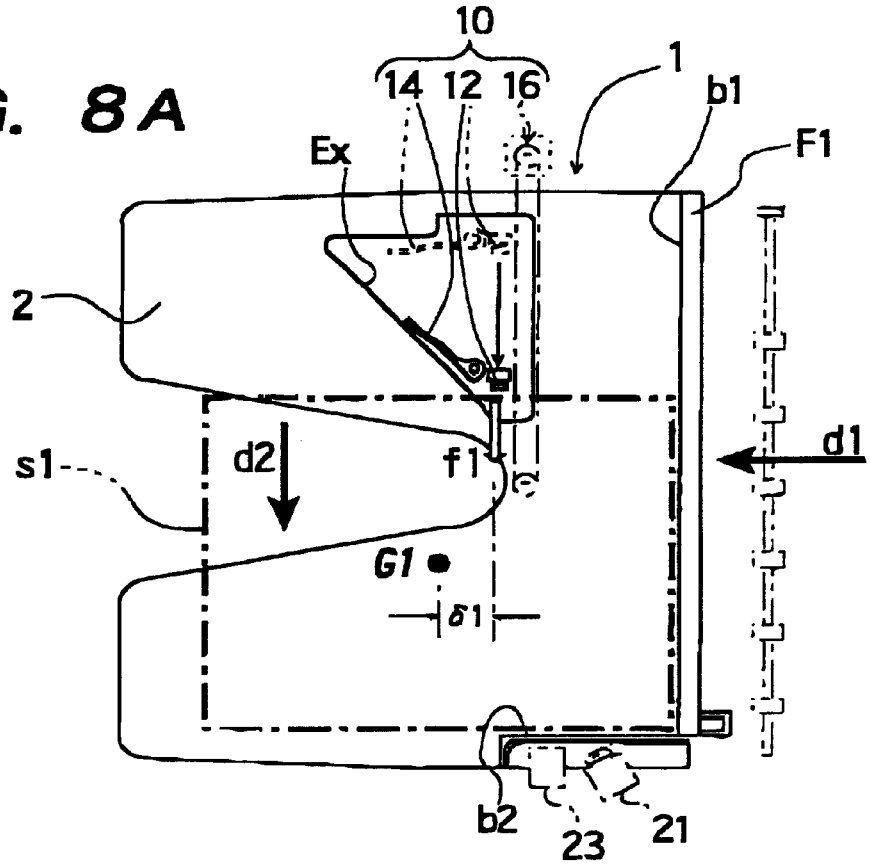
FIG. 8A and FIG. 8B are schematic plan views illustrative of the operating principle of the sheet alignment device of the invention.

Thus, a sheet of small size having the width extending from the lateral aligning reference surface b2 to the second half L2 is pushed only by the moving aligning member 12 against the lateral aligning reference surface b2 (FIG. 8A). On the other hand, a sheet of large size having the width from the lateral aligning reference surface b2 to the first half L1 is pushed against the lateral aligning reference surface b2 by the associated moving aligning member 12 and variable push member 14 (FIG. 8B).

As a result, the sheet alignment device of the invention can exert the pushing force on the sheets at the effective point close to the center of gravity of the sheets, so that the sheets of any size stacked on the tray can be suitably aligned with the prescribed lateral aligning reference surface b2.

To put it concretely, according to the sheet alignment device of the invention, the sheet s1 of small size as shown in FIG. 8A is pushed in the direction d2 only by the movable aligning member 12. Since the deflection δ1 from the sheet pushing point at which the sheet is pushed by the movable aligning member 12 to the center of gravity G1 is small at this time, little rotational moment around the center of gravity G1 which is imparted to the sheet is generated little by the pushing force f1.

Figure 8B:
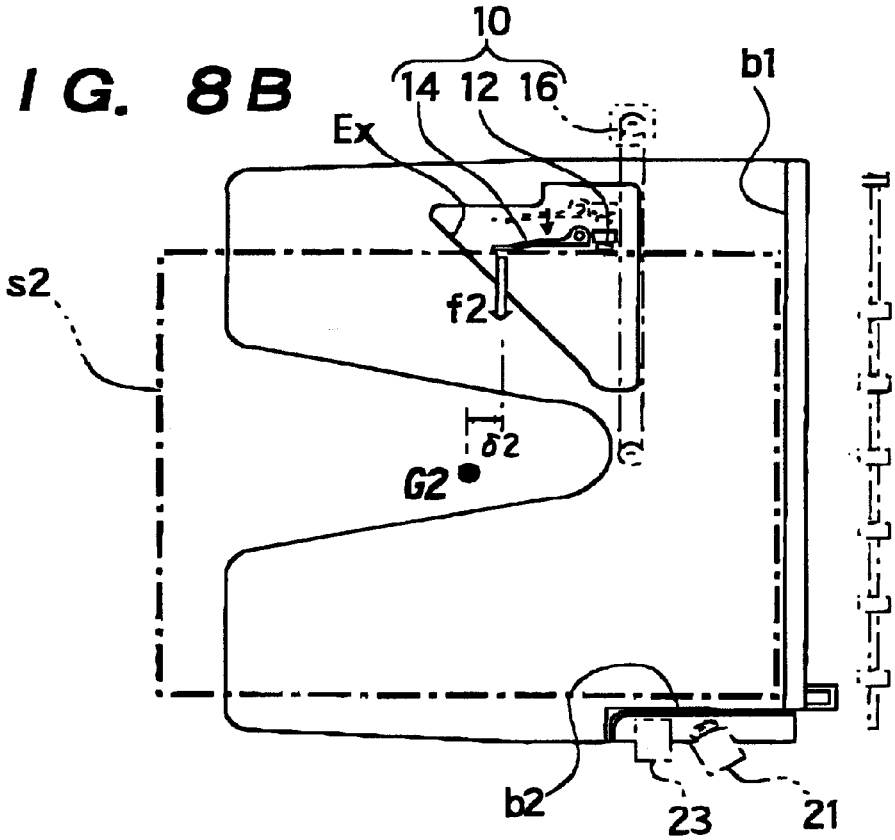

Similarly, even when the sheet s2 of large size as shown in FIG. 8B is given, the variable push member 14 acts on the sheet with the minimum deflection δ2 from the sheet pushing point to the center of gravity G2 to efficaciously exert the pushing force f2 on the sheet in the direction d2. If the is sheet s2 is pushed only by the movable aligning member 12 without using the variable push member 14 as done in a conventional sheet alignment device, the deflection from the sheet pushing point to the center of gravity G2 becomes large to bring about an undesirable rotational moment around the center of gravity, which possibly results in failure to align the sheet or jamming.

Hence, according to the sheet alignment device 10 of the invention, the position at which the pushing force for aligning one or more sheets is exerted on the sheets can be shifted near the center of gravity of the sheets owing to the variable push member 14, consequently to increase the efficiency of exerting the pushing force on the sheets and properly align the sheets in accordance with the size of the sheet.

As is described above, the sheet alignment device of this invention has a function of exerting the pushing force on the sheets at the effective point (point of action f1) close to the center of gravity GI of the sheet of small size with only the movable aligning member 12, or at the effective point (point of action f2) close to the center of gravity G2 of the sheet of large size with the associated movable aligning member 12 and variable push member 14. Accordingly, one or more sheets fed onto the tray are pushed at either one of the points of pushing action in accordance with the size of the sheets, thus to be exactly aligned with not only the widthwise aligning reference surface b1, but also the lateral aligning reference surface b2.

In the drawings, reference numeral 21 denotes a stapler mounted on one side of the tray positioned at the sheet receiving portion 6, and reference numeral 23 denotes means for holding and transferring to the stapler 21 the sheets aligned by the sheet alignment device of the invention on the tray positioned at the sheet receiving portion 6. The stapler 21 and the sheet holding and transferring means 23 are not indispensable to this invention. Although the foregoing embodiment functions to automatically select either one of the points of pushing action in accordance with the size of the sheets to be aligned, it is obvious that sheets of various sizes can be suitably handled with increasing the number of the points of pushing action. The sheet alignment device 40 shown in FIG. 9A and FIG. 9B as the second embodiment of the invention bears three pushing points for dealing with a sheet larger than that used in the foregoing embodiment or a sheet of medium size in addition to sheets of large and small sizes. Namely, the second embodiment serves to achieve precise alignment of the sheets of various sizes. For the convenience of description, the sheet alignment device for dealing with he sheets of large, medium and small sizes will be described.

The sheet alignment device 40 comprises a movable aligning member 42, a variable push member consisting of a medium-size sheet pushing element 44 and a large-size sheet pushing element 45, and means 46 for moving the movable aligning member 42 and the variable push member consisting of the pushing elements 44 and 45 in the aligning direction d2. In short, this second embodiment is equivalent to the foregoing first embodiment except the variable push member consisting of the medium-size sheet pushing element 44 and the large-size sheet pushing element 45. The pushing elements 44 and 45 during forward movement are differentially restrained by the operation converting means Ex formed on the tray 2, so as to be retracted backward by the operation converting means Ex.

The medium-size sheet pushing element 44 is slidably fitted into a dovetail groove 42*a* formed in the movable aligning member 42, so that it can slide in parallel in the aligning direction d2.

The large-size sheet pushing element 45 connected rotatably to the medium-size sheet pushing element 44 by a hinge is substantially identical in structure with the member 14 in the foregoing first embodiment.

Figure 9A:
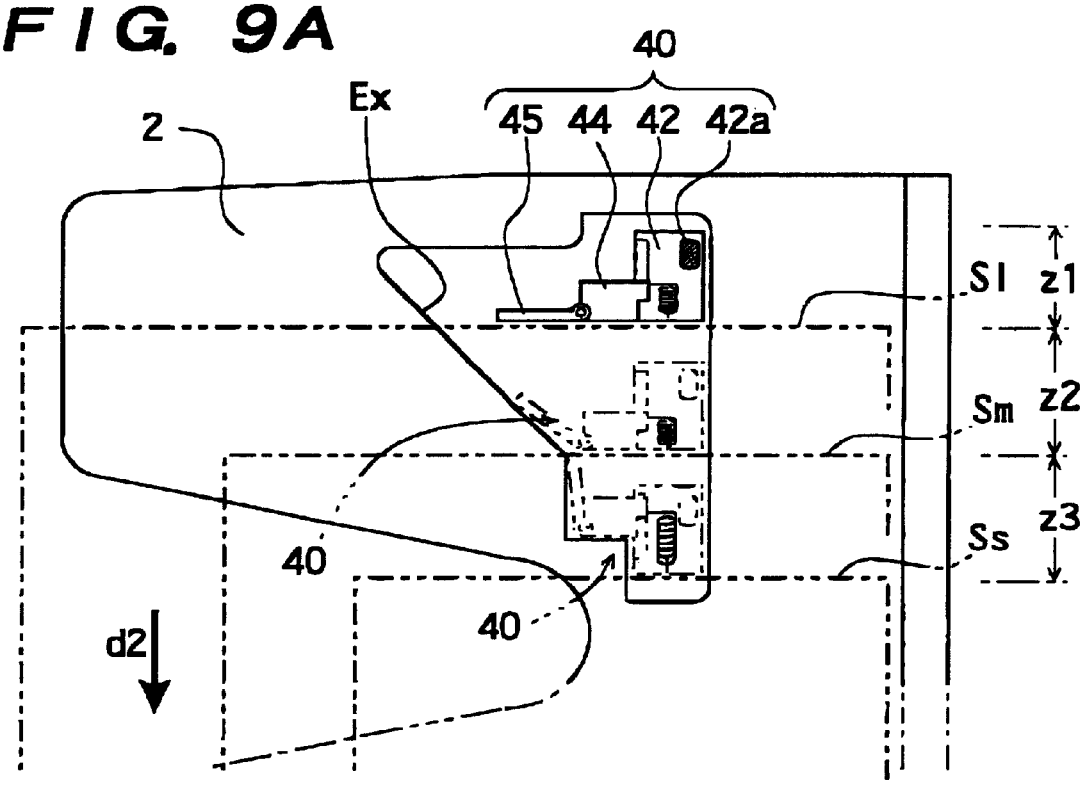
FIG. 9A and FIG. 9B are a plan view and a front view each schematically showing a second embodiment of this invention.
Figure 9B:
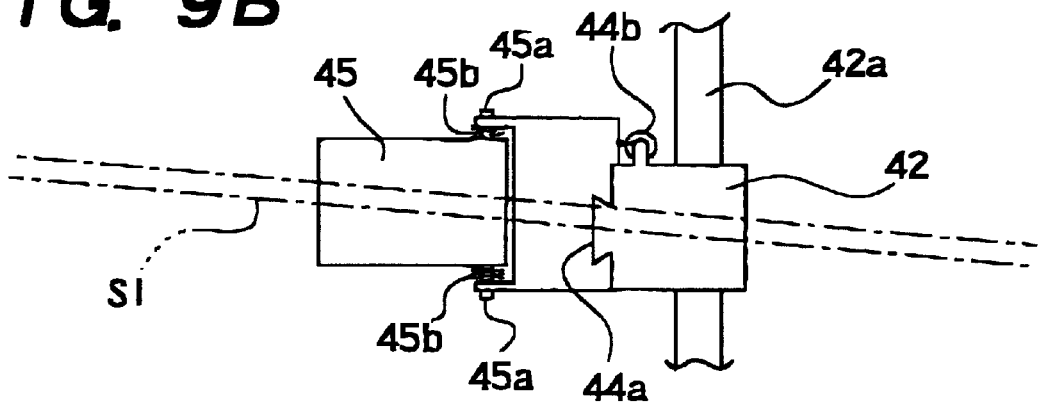

The medium-size and large-size sheet pushing elements 44 and 45 are resiliently urged by respective resilient means 44*a* and 45*a* such as a spring, so as to maintain the front surfaces of these pushing elements on the same plane with the front surface of the movable aligning member 42 relative to the aligning direction d2 in the region z1 for working on the large-size sheet S1, as depicted by the solid line in FIG. 9A.

A moving means 46 in this embodiment is identical in structure and function with the means 16 in the foregoing embodiment.

The operation converting means Ex formed along the edge of the opening 2*e* in this embodiment is not straight, but the shape of this means is not limited thereto and may be determined so as to selectively activate or deactivate the medium-size sheet pushing element 44 and the large-size sheet pushing element 45, respectively. Namely, the operation converting means Ex is so formed that the large-size sheet pushing element 45 is retracted backward in the region z2 for the medium-size sheet Sm so as to be out of contact with the medium-size sheet, and the medium-size sheet pushing element 44 is retracted backward in the region z3 for the small-size sheet Ss so as to be out of contact with the small-size sheet.

According to the second embodiment, one or more sheets of large size placed on the tray are pushed at the aforementioned three pushing points by the movable aligning member 42, the medium-size sheet pushing element 44 and the large-size sheet pushing element 45, which are retained movably back and forth by the moving lever 42*a*, toward the lateral aligning reference surface is defined on the side edge of the tray, thus to be aligned with the aligning reference surface.

Likewise, the sheets of medium size on the tray are pushed at the two pushing points by the movable aligning member 42 and the medium-size sheet pushing element 44, thus to be aligned with the aligning reference surface. The sheets of small size on the tray are pushed at one pushing point only by the movable aligning member 42, thus to be exactly aligned with the aligning reference surface. Consequently, the sheets placed on the tray can be suitably pushed in the sheet aligning direction d2 at the effective points close to the center of gravity of the sheets, which are determined according to the size of the sheets.

Moreover, the adaptability of the sheet alignment device of the invention can be further enlarged coping with the sheets of various sizes to be dealt with in the device by modifying the variable push member applied in the foregoing embodiments. Various types of modified variable push members will be described hereinafter.

The sheet alignment device 10 of the third embodiment of the invention illustrated in FIG. 10 has the same movable aligning member 12 as those in the foregoing embodiments, and a variable push member 54 formed of resilient elastic material such as rubber and synthetic resin. Other elements indicated by the same reference symbols with respect to those of the first embodiment as described above have analogous structures and functions to those of the first embodiment.

The variable push member 54 is connected to the movable aligning member 12 and usually assumes its normal state depicted by the solid line in the drawing. When the variable push member 54 is moved forward in the aligning direction d2 to perform the sheet alignment, the push member 54 collides with the operation converting means Ex formed on the tray to be bent backward as depicted by the chain line in the drawing.

Consequently, the sheet of small size is pushed at the effective point close to the center of gravity of the sheet of small size by the movable aligning member 12 (with the pushing force fl), thus to be properly aligned. On the other hand, the sheet of large size is pushed at the effective point close to the center of gravity of the sheet of large size mainly by the variable push member (with the pushing force f2), thus to be properly aligned.

The fourth embodiment shown in FIG. 11 has a variable push member 64 resiliently hinged on the movable aligning member 12. When aligning sheets of large size, the variable push member is projected forward ahead of the movable aligning member 12 (the state depicted by the solid line). According to this embodiment, the sheet of large size is pushed mainly by the variable push member 64, and the sheet of small size is pushed only by the movable aligning member 12. When dealing with the sheet of small size, the variable push member is retracted backward by the operation converting means Ex formed on the tray, so as not to act on the sheet.

The fifth embodiment shown in FIG. 12 is equivalent to the first embodiment described above, except for a variable push member 74 formed of material having high coefficient of friction such as rubber and synthetic resin. This embodiment excels in the ability to hold the sheets and brings about a useful effect according to the usage thereof.

Figure 13:
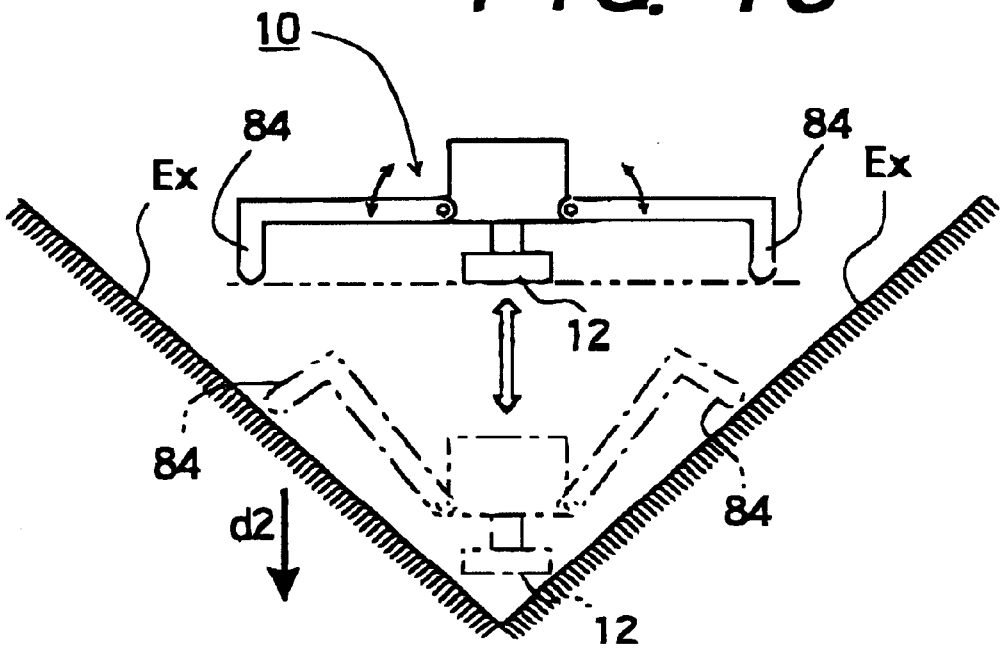
FIG. 13 is a schematic plan view of a sixth embodiment of this invention.

The sixth embodiment shown in FIG. 13 has a pair of variable push members 84 resiliently hinged one on either side of the movable aligning member 12. The variable push members 84 are disposed symmetrically so as is to be retracted backward when moving forward to collide with the operation converting means Ex.

The variable push members 84 are kept on the same plane with the movable aligning member 12 when dealing with the sheet of large size, so that the effective pushing force produced by the push members is exerted on the sheets over a wide extent defined between the variable push members including the point facing the center of gravity of the sheet.

Figure 14:
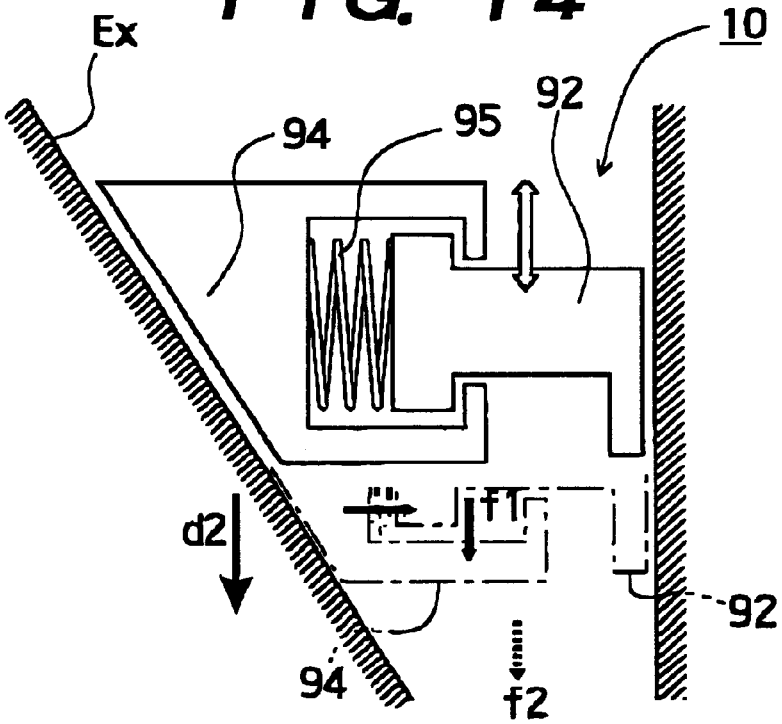
FIG. 14 is a schematic plan view of a seventh embodiment of this invention.

The seventh embodiment shown in FIG. 14 comprises a variable push member 84 and an aligning member 92 movable in parallel in the aligning direction d2, which are resiliently connected telescopically with each other. The variable push member 94 is expandable by a resilient means 95 such as a spring so as to vary an effective pushing point at which the sheet is pushed efficaciously.

That is to say, the effective pushing point which is substantially deemed as the center of a sheet contacting area of the associated movable aligning member 92 and variable push member 94 can be moved to either the position f1 when dealing with the sheet of large size or the position f2 when dealing with the sheet of small size. Namely, the effective pushing point can be automatically shifted to the position close to the center of gravity of the sheet in accordance with the size of the sheet.

Figure 15A:
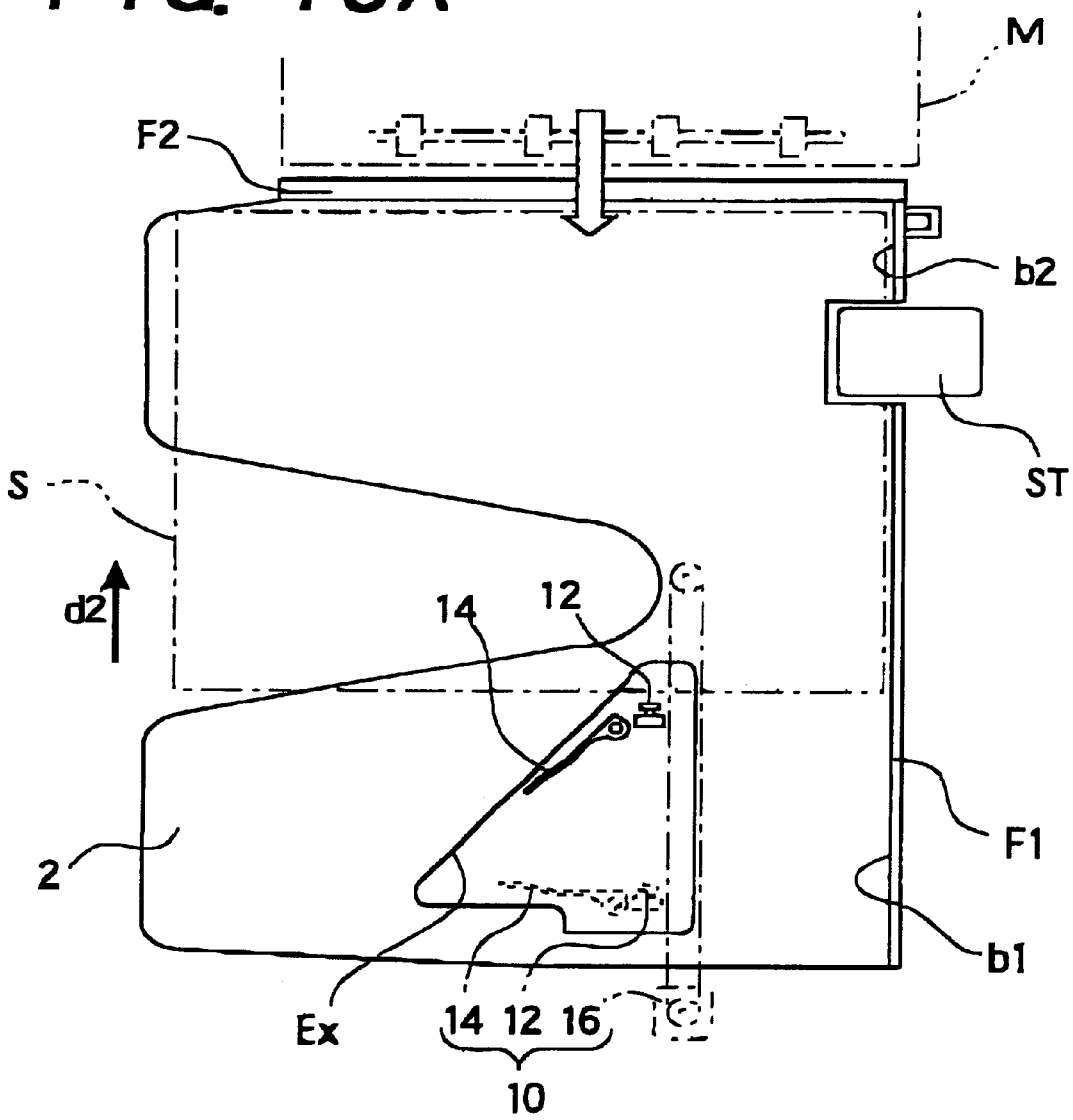
FIG. 15A and FIG. 15B are a plan view and a front view each schematically showing an eighth embodiment of this invention.
Figure 15B:
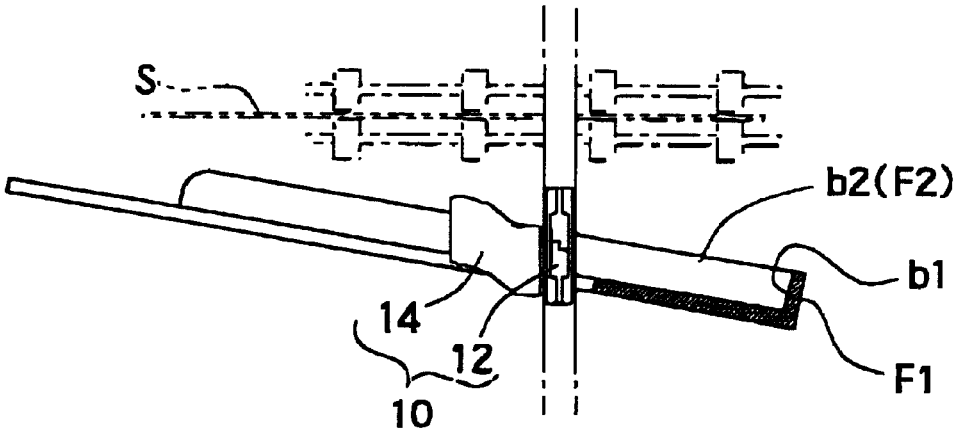

FIG. 15A and FIG. 15B illustrate the eighth embodiment in which the sheet alignment device of the invention is applied to a sheet handling device for receiving one or more sheets fed from the image forming apparatus M in the sheet introduction direction d1 and aligning the sheets on the tray 2 in the sheet aligning direction d2 parallel to the direction d1.

To be exact, the sheet introduction direction d1 is opposite to the sheet aligning direction d2. The sheet alignment device 10 of this eighth embodiment is practically the same as the foregoing embodiments, though the sheet aligning direction d2 is inverted. Namely, the sheet alignment device 10 comprises the movable aligning member 12, the variable push member 14, and the moving means 16 similarly to the foregoing embodiment.

The stapler ST in this embodiment is mounted on the side of the sheet receiving wall F1 forming the widthwise aligning reference surface b1 on the tray 2.

In this embodiment, when one or more sheets S are fed from the image forming apparatus M in the direction d1 onto the tray 2, the sheets S on the tray are pushed toward the lateral aligning reference surface b2 defined on the wall F2 by the sheet alignment device 10 which is operated in accordance with the size of the given sheets, thus to be aligned with the aligning reference surface. The sheets aligned lengthwise and crosswise are stapled by the stapler ST as required.

The sheets stacked on the tray are pushed at the position closed to the center of gravity by the sheet alignment device of the invention, thus to be suitably aligned.

Figure 16:
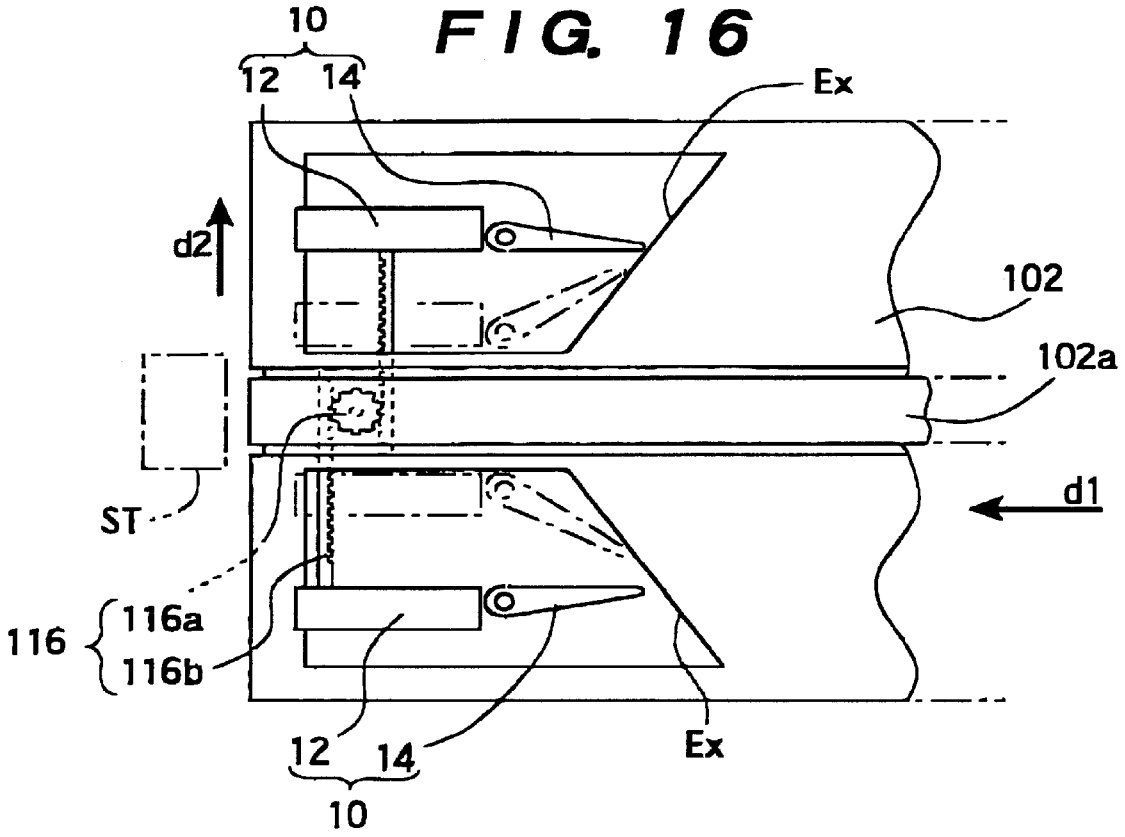
FIG. 16 is a schematic plan view of a ninth embodiment of this invention.

FIG. 16 illustrates the ninth embodiment in which the sheet alignment device 10 of the invention is incorporated in a bookbinding unit of a sheet finisher for a copying machine. The bookbinding unit is provided with trays 102 divided by a sheet transferring belt 102*a*. Each tray 102 has an opening 102*b* in which a sheet alignment device 10 including a movable aligning member 112 and a variable push member 114 are positioned. On the extension of the sheet transferring belt 102*a*, a stapler ST is disposed.

The movable aligning members 112 on the both trays 102 are simultaneously driven by a driving mechanism 116 including a pinion 116*a* and racks 116*b* so as to recede from or approach each other. That is, by operating the driving mechanism 116, the distance between the movable aligning members 112 can be varied in relation to the transferring belt 102*a*.

Each variable push member 114 is supported rotatably by an axis 114*a* secured on the movable aligning member 112 and restricted in its forward movement by the operation converting means Ex formed in each tray, so that it collides with the operation converting means to retract backward when approaching the transferring belt.

According to this embodiment, one or more sheets fed onto the trays by the transferring belt 102*a* in the direction d1 are held between two sets of the associated movable aligning members and variable push members. With the sheet alignment device, the optimum pushing force produced by either the movable aligning members or variable push members is exerted on the sheets at the point close to the center of gravity of the sheets, consequently to properly align the sheets. The sheets thus aligned are stapled by the stapler ST as required, and then, the stapled sheets are sent back by the transferring belt 102*a*.

Figure 17:
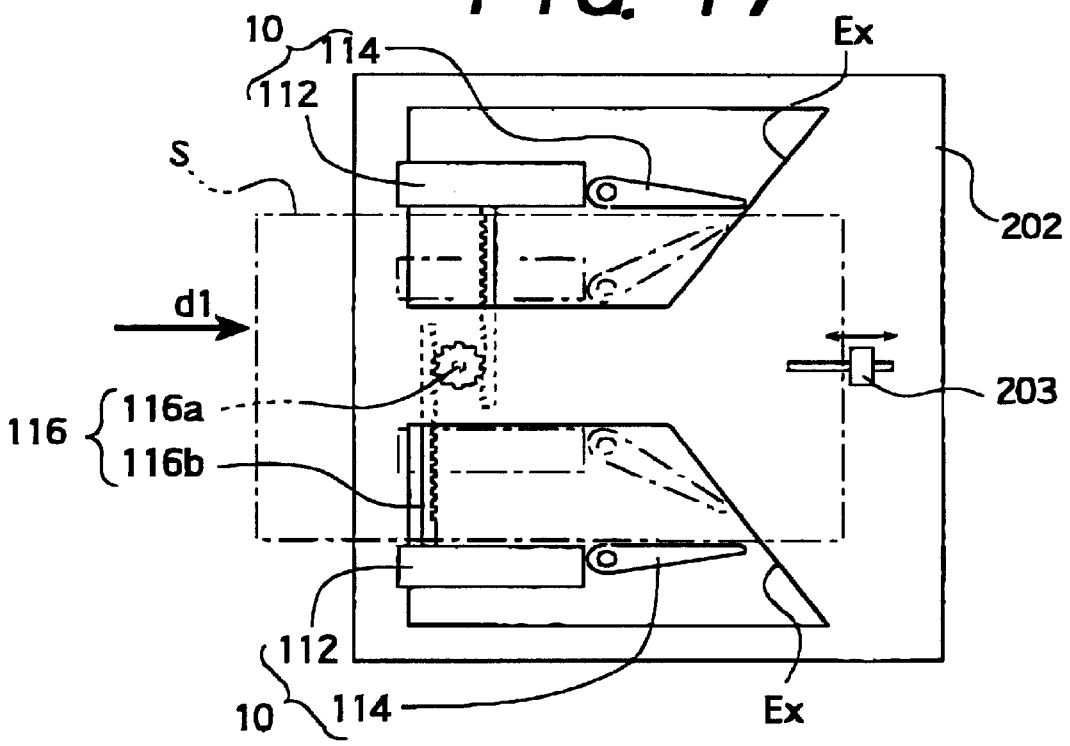
FIG. 17 is a schematic plan view of a tenth embodiment of this invention.

FIG. 17 illustrates the tenth embodiment in which the sheet alignment device 10 of the invention is incorporated in a sheet inverting system for turning over a duplex sheet upside down in a duplex copying machine as one example. The sheet alignment device 10 comprising movable aligning members 112, variable push members 114 and moving means 116 is substantially equivalent in structure and function to that in the foregoing embodiment shown in FIG. 16.

The sheet inverting system in this embodiment is provided with a sheet positioning regulator 203 for positioning the sheet to be aligned in the sheet introduction direction d1 to appropriately transfer the sheet with exquisite timing. Namely, the tail end (left end in the drawing) of the sheet S fed onto the tray relative to the direction d1 is accurately positioned by the positioning regulator 203.

When giving a sheet of large size, the pushing force produced specifically by the associated movable aligning member 112 and variable push member 114 (depicted by the solid line in the drawing) is imparted to the entire region defined by the members 112 and 114 including the center of gravity of the sheet. On the other hand, when dealing with a sheet of small size, the pushing force produced only by the movable aligning member 112 (depicted by the chain line in the drawing) is given to the position close to the center of gravity of the sheet. Consequently, the most suitable sheet alignment can be accomplished.

Figure 18:
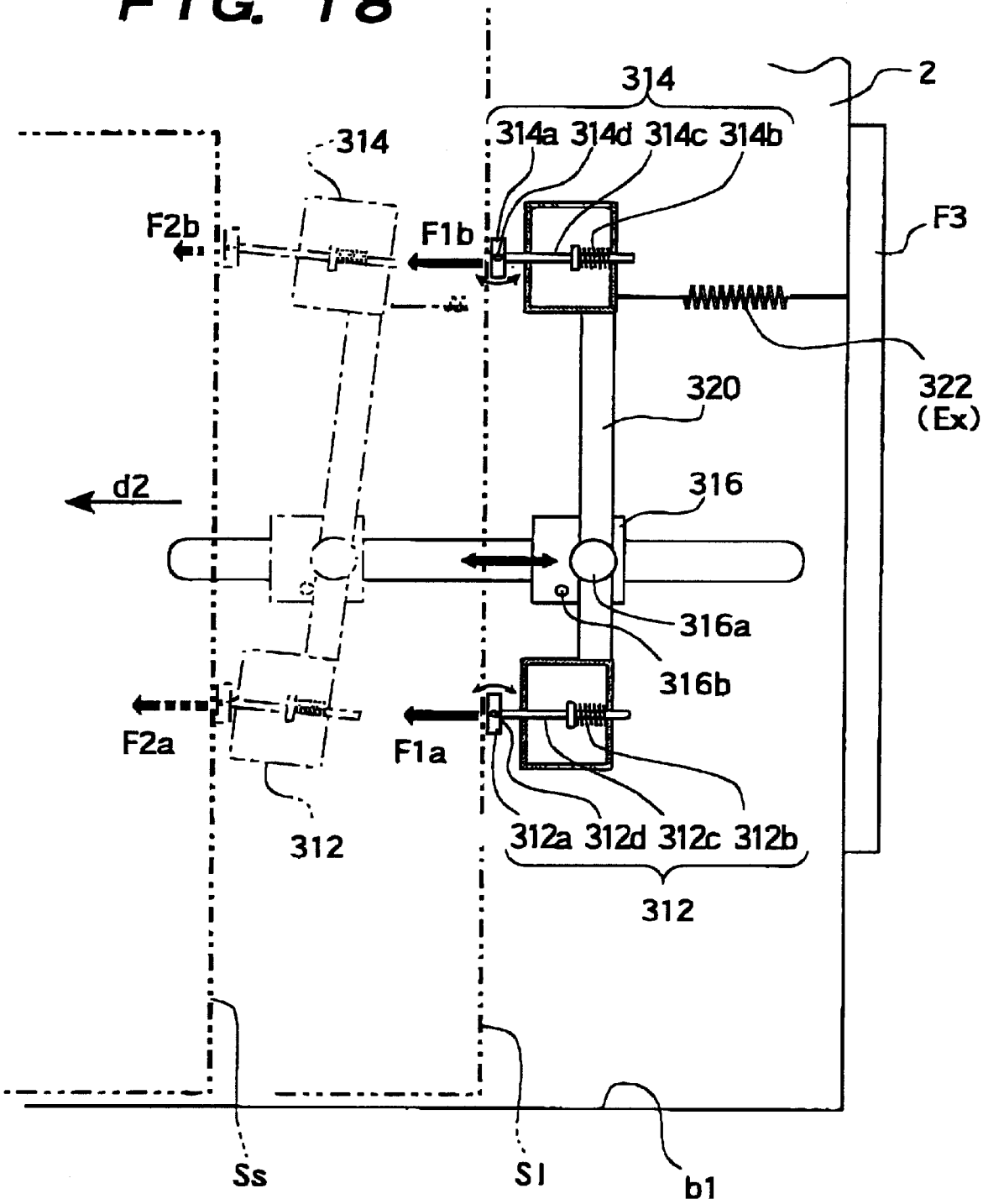
FIG. 18 is a schematic plan view of an eleventh embodiment of this invention.

The sheet alignment device shown in FIG. 18 employs the operation converting means Ex formed of resilient means such as a spring. The sheet alignment device 10 in this embodiment comprises a movable aligning member 312, a variable push member 314, and moving means 316 for moving back and forth the associated movable aligning member 312 and variable push member 314 in the aligning direction d2.

The movable aligning member 312 and variable push member 314 are mounted one on either end of an arm 320 rotatably supported by a rotary axis 316*a* secured on the moving means 316. The variable push member 314 is resiliently retained by the operation converting means Ex formed of the spring 322 suspended between the variable push member and the side wall F3 of the tray 2.

The resilient force of the spring 322 is so determined that pushing forces F1*a* and F1*b* exerted on the sheet by the movable aligning member 312 and variable push member 314 are substantially balanced with each other when one or more sheets of large size are given as depicted by the solid line in the drawing, but the pushing force F2*a* of the movable aligning member 312 becomes larger than the pushing force F2*b* of the variable push member 314 when dealing with one or more sheets of small size as depicted by the imaginary line in the drawing.

In brief, the pushing forces produced by the movable aligning member 312 and the variable push member 314 are made equal to each other when aligning the maximum sheet which can be handled by the sheet alignment device, and the pushing force produced by the variable push member 314 becomes small with reducing the sheet to be aligned in size. To be more specific, the effective pushing point at which the maximum sheet is pushed efficaciously by the associated movable aligning member 312 and variable push member 314 should be positioned nearly at the middle of the members 312 and 314, but it is shifted to the movable aligning member 312 with reducing the sheet in size. As a result, the effective pushing point at which one or more sheets on the tray are pushed by the associated movable aligning member and variable push member is shifted along the widthwise aligning reference surface b1 toward the center of gravity of the sheets in accordance with the size of the sheets.

In addition, the movable aligning member 312 has a sheet contacting piece 312*a* rotatably supported on one end of a push rod 312*c* urged by a spring 312*b* through an axis 312*d*. Similarly, the variable push member 314 has a sheet contacting piece 314*a* rotatably supported on one end of a push rod 314*c* urged by a spring 314*b* through an axis 314*d*. With this structure, the entire front flat surfaces of the sheet contacting pieces 312*a* and 314*a* of the movable aligning member 312 and variable push member 314 always come into close contact with the edge of the sheet on the tray even when the arm 320 takes its posture substantially perpendicular to the sheet aligning direction d2 (as depicted by the solid line in the drawing) when aligning the large-size sheets SI, or even when the arm 320 is inclined (as depicted by the chain line). When the given sheet is too small, the sheet contacting piece 314*a* of the variable push member 314 may possibly be out of contact with the sheet. In the drawing, reference numeral 316*b* denotes a stopper disposed on the moving means 316 to prevent the arm 320 from rotating excessively.

The sheet alignment device including the movable aligning member 312 and variable push member 314 in this embodiment can establish the desired function of suitably aligning the sheets fed from the sheet handling device.

As is apparent from the foregoing description, according to the sheet alignment device of this invention, since the point at which the effective pushing force produced by the movable aligning member for unconditionally urge one or more sheets on the tray and the variable push member for conditionally urge the sheets can be shifted to the position close to the center of gravity of the sheets, the sheets of any size can be properly aligned without experiencing an undesirable rotational moment.

Furthermore, the variable push member of the alignment device can be automatically operated to selectively urge the given sheets or retreat from the sheets in accordance with the size of the given sheets only by the operation converting means which can be simply formed of the edge of the opening in the tray of the sheet storage unit, so that the sheet or sheets can be properly aligned with the simple operation of the associated movable aligning member and variable push member.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. A sheet alignment device comprising:

a sheet storing unit for storing one or more sheets of a size, said one or more sheets having a center of gravity;

at least one sheet aligning means including a movable aligning member movable back and forth relative to an edge of said one or more sheets on said storage unit in a sheet aligning direction, and at least one variable push member movable in conjunction with said movable aligning member to push said edge of said one or more sheets;

means for moving back and forth said at least one sheet aligning means; and an operation converting means for activating or deactivating said variable push member in accordance with the said one more sheets;

said at least one sheet aligning means being moved to urge said one or more sheets at a pushing point, said pushing point shifting in accordance with said center of gravity of said one or more sheets as determined by the size of said one or more sheets, said movable aligning member and variable push member being arranged so that, when said one or more sheets on said storing unit are of a small size, said movable aligning member pushes said one or more sheets of small size, while being in contact with said one or more sheets at a portion close to the center of gravity of said sheets of small size and keeping said variable push member out of contact with said sheets of small size, and when said one or more sheets are of a large size, the variable push member along with said movable aligning member pushes said one or more sheets of large size, thereby to exert a pushing force on one or more sheets at a portion close to the center of gravity of the sheet of large size.

2. The sheet alignment device comprising:

a sheet storing unit for storing one or more sheets of a size, said one or more sheets having a center of gravity:

at least one sheet aligning means including a movable aligning member movable back and forth relative to an edge of said one or more sheets on said storing unit in a sheet aligning direction, at least one variable push member movable in conjunction with said movable aligning member to push said edge of said one or more sheets in accordance with the size of said one or more sheets; and means for moving back and forth said at least one sheet aligning means;

said at least one sheet aligning means being moved to urge said one or more sheets at a pushing point, said pushing point being shifted in accordance with said center of gravity of said one or more sheets determined by the size of said one or more sheets;

wherein said sheet storing unit includes trays having an opening with an edge serving as an operation converting means for activating or deactivating said variable push member in accordance with the size of said one or more sheets.

3. The sheet alignment device as claimed in claim 1, wherein said sheet storing unit includes a sheet aligning reference surface toward which said sheet aligning means is movable back and forth.

4. The sheet alignment device as claimed in claim 1, wherein two sets of said sheet aligning means are disposed as opposed to each other and movable back and forth relative to each other.

5. The sheet alignment device as claimed in claim 4, further comprising a sheet transferring means between said two sets of said sheet aligning means.

6. The sheet alignment device as claimed in claim 4, further comprising a sheet positioning regulator for positioning said one or more sheets to be aligned in the sheet aligning direction.

7. The sheet alignment device as claimed in claim 1, wherein said variable push member is operated to push one or more sheets of large size, and said movable aligning member is operated to push one or more sheets of small size.

8. The sheet alignment device as claimed in claim 1, wherein said variable push member is formed of a large-size sheet pushing element for aligning one or more sheets of large size and a medium-size sheet pushing element for aligning one or more sheets of medium size, and said movable aligning member is operated to align one or more sheets of small size.

9. The sheet alignment device as claimed in claim 1, wherein said variable push member is formed of a flap-like plate rotatably connected to said movable aligning member.

10. The sheet alignment device as claimed in claim 1, wherein said variable push member is formed of resilient elastic material.

11. The sheet alignment device as claimed in claim 1, wherein said variable push member is disposed on each side of said movable aligning member.

12. The sheet alignment device as claimed in claim 1, wherein said movable aligning member and said variable push member are resiliently connected telescopically with each other.

13. The sheet alignment device as claimed in claim 1, wherein said moving means has an arm rotatably secured thereon, and said movable aligning member and said variable push member are mounted one on either end of said arm.

14. A sheet alignment device comprising:

a sheet storing unit for storing one or more sheet of a size, said one or more sheets having a center of gravity;

sheet aligning means movable back and forth relative to an edge of said one or more sheets on said storing unit in a sheet aligning direction, said sheet aligning means including a movable aligning member and a variable push member;

means for moving back and forth said sheet aligning means, said moving means having an arm, said movable aligning member and said variable push member being mounted on either end of said arm;

an operation converting means for activating or deactivating said variable push member in accordance with the size of said one or more sheets;

said at least one sheet aligning means being moved to urge said one or more sheets at a pushing point, said pushing point being shifted to a position close to said center of gravity of said one or more sheets where the relationship between the pushing point location to the center of gravity is determined by the size of said one or more sheets;

said movable aligning member and variable push member being so arranged that when said one or more sheets on said storing unit are small size, said movable aligning member pushes said one or more sheets while being in contact with said one or more sheets at a portion close to said center of gravity of said sheets of small size, and when said one or more sheets are large size, the variable push member pushes said one or more sheets of large size in company with said movable aligning member, while keeping said variable push member out of contact with sheets of small size, to exert a pushing force on one or more sheets at a portion close to the center of gravity of the sheet of large size.

15. The sheet alignment device as claimed in claim 14, wherein said operation converting means is a spring.

16. A sheet alignment device comprising:

a sheet storing unit for storing one or more sheets of a size, said one or more sheets having a center of gravity determined by the size of said one or more sheets;

at least one sheet aligning means including a movable aligning member movable back and forth relative to an edge of said one or more sheets on said storing unit in a sheet aligning direction, and at least one variable push member movable in conjunction with said movable aligning member to push said edge of said one or more sheets in accordance with the size of said one or more sheets;

means for moving back and forth said at least one sheet aligning means; and an operation converting means for activating or deactivating said variable push member in accordance with the said one or more sheets;

said at least one sheet aligning means being moved to urge said one or more sheets at pushing point defined in a region of said edge, said region being increased when dealing with said one or more sheets of a relatively large size and decreased when dealing with said one or more sheets of a relatively small size.

* * * * *